US007271763B2

(12) United States Patent
Rock

(10) Patent No.: US 7,271,763 B2
(45) Date of Patent: Sep. 18, 2007

(54) HYBRID-PHASED COMMUNICATION ARRAY

(75) Inventor: Janice C. Rock, Lacey's Spring, AL (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/071,428

(22) Filed: Mar. 3, 2005

(65) Prior Publication Data

US 2006/0197703 A1 Sep. 7, 2006

(51) Int. Cl.
*H01Q 3/26* (2006.01)

(52) U.S. Cl. ..... 342/374

(58) Field of Classification Search ..... 342/374, 342/372

See application file for complete search history.

(56) References Cited

U.S. PATENT DOCUMENTS 5,093,667 A * 3/1992 Andricos ..... 342/372
5,351,053 A * 9/1994 Wicks et al. ..... 342/372
5,659,322 A * 8/1997 Caille ..... 342/188
5,854,610 A * 12/1998 Wojtowicz et al. ..... 342/372
6,140,962 A * 10/2000 Groenenboom ..... 342/372
6,650,291 B1 * 11/2003 West et al. ..... 342/371
6,741,207 B1 * 5/2004 Allison et al. ..... 342/371
6,756,939 B2 6/2004 Chen et al.
6,759,980 B2 7/2004 Chen et al.
6,762,722 B2 7/2004 Chiang et al.
6,798,315 B2 9/2004 Schaefer
6,828,556 B2 12/2004 Pobanz et al.
6,836,194 B2 12/2004 Wheeler et al.
2003/0156060 A1 * 8/2003 Revankar et al. ..... 342/372
2004/0150554 A1 * 8/2004 Stenger et al. ..... 342/371

OTHER PUBLICATIONS

Federal Standard 1037C, Telecommunications: Glossary of Telecommunication Terms, p. C-13, 1996.*
D. Parker et al., Phased arrays—part 1: theory and architectures, IEEE Transactions on Microwave Theory and Techniques, □□vol. 50(3), p. 678-687, Mar. 2002.*
"module", Merriam-Webster Collegiate Dictionary, 10th Edition, p. 748, 1998.*
"Gallium Arsenide IC Applications Handbook", Inder BAhl and Dave Hammers, Edited by Dennis Fisher and Inder Bahl, pp. 94, Academic Press, 1994.

* cited by examiner

*Primary Examiner*—Thomas H. Tarcza
*Assistant Examiner*—Fred H. Mull
(74) *Attorney, Agent, or Firm*—Michael K. Gray

(57) ABSTRACT

A communication module is provided with a Transmit/Receive (T/R) element fabricated from psuedomorphic HEMT, High Electron Mobility Transistor technology (PHEMT). The T/R element drives multiple Radio Frequency MEMS switch-based phasing elements. Each of the phasing elements connects to a corresponding radiation element. A large quantity of the communication elements can be placed on a single substrate chip so as to provide for a reliable and cost effective device.

19 Claims, 2 Drawing Sheets

HYBRID-PHASED COMMUNICATION ARRAY

DEDICATORY CLAUSE

The invention described herein may be manufactured, used and licensed by or for the U.S. Government for governmental purposes without payment of any royalties thereon.

BACKGROUND OF THE INVENTION

I. Field of the Invention

The present invention pertains to drivers for radiating elements and electronically steerable arrays.

More particularly the present invention pertains to a communication device having a Transmit/Receive (T/R) element fabricated from HEMT (High Electron Mobility Transistor) technology, that advantageously drives multiple radiating elements.

II. Discussion of the Background

Historically, electronically steerable phased arrays have utilized two types of designs.

With reference to FIG. 1, the passive Electronically Steerable Array (ESA) 14 has a transmitter/receiver 18 for driving a plurality of arrayed phase shifters 16 that are connected to a radiating element or elements 10. The array 14 is passive in that it is dependent upon a single high-peak-power tube transmitter/receiver 18. Should the transmitter receiver 18 fail, the entire array 14 becomes inoperational.

In FIG. 2, an active Electronically Steerable Array 20 has many transmit receive elements as demonstrated in a row 22 of transmit/receive elements. Each of the transmit/receive elements of row or network 22 is directly connected to a corresponding phase element in row or network 24 of phase elements. In the active ESA of FIG. 2, the row 22 of T/R elements is positioned between the radiating element or elements 26 and the row of phase elements 24. In FIG. 4, the schematic diagram of an array column 25 demonstrates the element geometry of an active ESA in that the transmit/receive element $\mathbf{22}_1$ is positioned between the phase element $\mathbf{24}_1$ and the radiating element $\mathbf{26}_1$.

The schematic diagram of FIG. 3 will provide explanation for the reason transmit/receive element $\mathbf{22}_1$ of the active ESA is positioned between the phase element $\mathbf{24}_1$ and the radiating element $\mathbf{26}_1$.

With reference to FIG. 3, transmit/receive element $\mathbf{22}_1$ is comprised of a number of electrical components. A switch 48 alternatively connects radiating element $\mathbf{26}_1$ to low noise amplifier 28 during receive mode or to power amplifier 46 during transmit mode. Low-noise amplifier 28 connects to band-pass filter 30 that connects to a mixer 32. Mixer 32 mixes the received signal with a current received from an oscillator with the mixed signal proceeding to amplifier 34. Amplifier 34 connects to a switch 36 which opens and closes depending upon the mode of operation. Amplifier 38 is located between and connects to phase shifter $\mathbf{24}_1$ and to multiplier or mixer 42. A mixed signal proceeds from mixer 42 to band-pass filter 44 to power amplifier 46. When switch 48 connects to power amplifier 48, a signal can be transmitted through radiating element $\mathbf{26}_1$.

To achieve the best performance for active ESA array elements such as those depicted in FIGS. 2-4, the low noise amplifier 28 needs to be positioned as close as possible to the radiating element $\mathbf{26}_1$ due to the relatively low peak power of the transmitter/receiver $\mathbf{22}_1$. As the distance of the low noise amplifier 28 from the radiating element increases, signal loss increases and performance decreases.

The transmitter/receiver 18 of the passive ESA of FIG. 1 has sufficient power to drive the radiating elements 10, but since the large drive signal has to travel through the phase shifters 16, unwanted noise is created. Further, as has been pointed out, should the transmitter/receiver 18 fail, the entire device will fail.

SUMMARY OF THE INVENTION

Accordingly, one object of the present invention is to provide a communication module having a relatively low power T/R element which can drive a plurality of radiating elements.

Yet another object of the present invention is provide an array of communication modules with each module of the array having a respective low powered T/R element which effectively drives a corresponding respective plurality of radiating elements.

Still another object of the present invention an array of communication modules that are economical to manufacture.

These and other valuable objects are realized by a communication module that includes a PHEMT-T/R module; a plurality of phase elements; a switching means connecting the PHEMT-T/R module to the plurality of phase elements; and a plurality of radiating elements. Each phase element of the plurality of phase elements is directly connected to a corresponding radiating element of the plurality of radiating elements. The plurality of phase elements comprise RF MEMS switch-based phasing elements. The plurality of phase elements are positioned between the plurality of radiating elements and a low noise amplifier.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION

Figure 1:
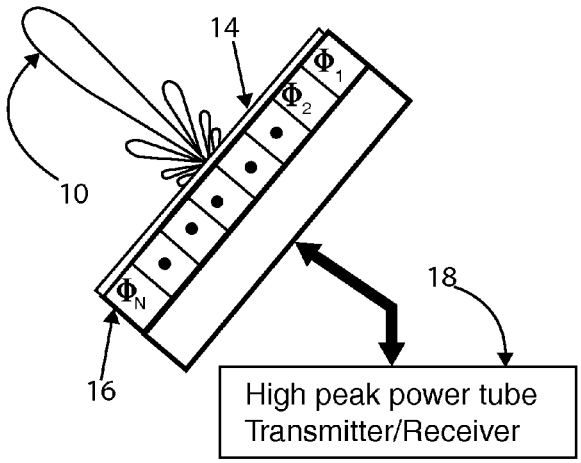
FIG. 1 (Prior Art)
FIG. 1 is a prior art schematic illustration of a passive Electronically Steerable Array.
Figure 2:
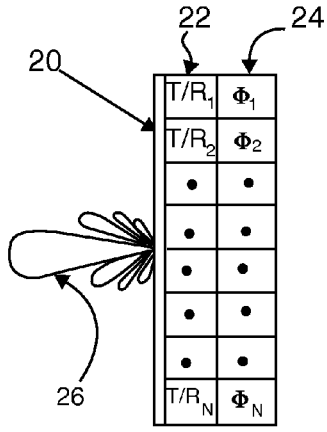
FIG. 2 (Prior Art)
FIG. 2 is a prior art schematic illustration of an active Electronically Steerable Array.
Figure 3:
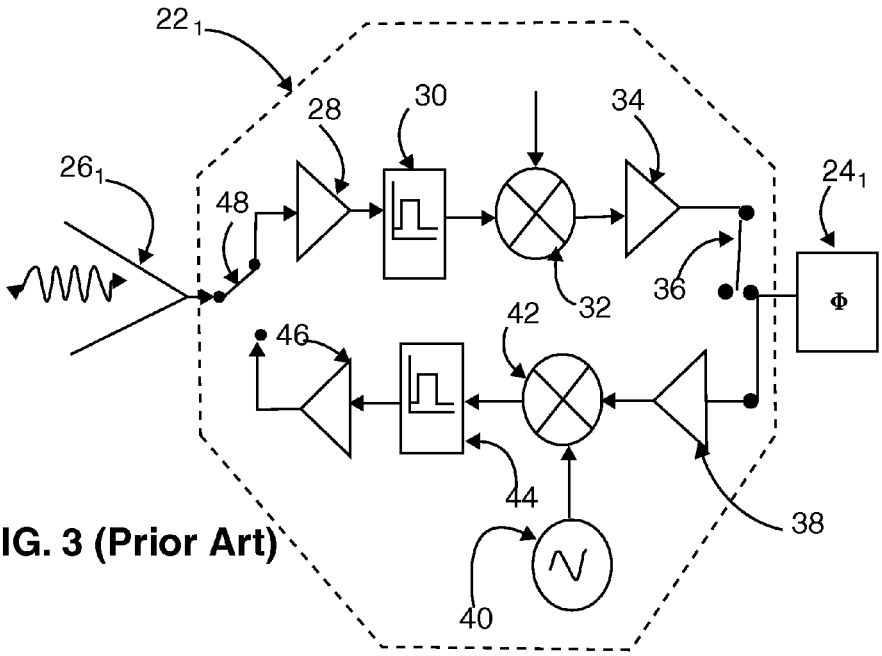
FIG. 3 (Prior Art)
FIG. 3 is a prior art schematic illustration of the typical components in a T/R array such as the array of FIG. 2.
Figure 4:
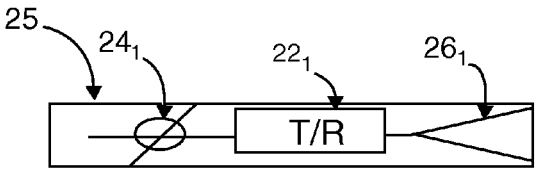
FIG.4 (Prior Art)
FIG. 4 is a prior art schematic illustration of the geometric positioning of components in an active Electronically Steerable Array.
Figure 5:
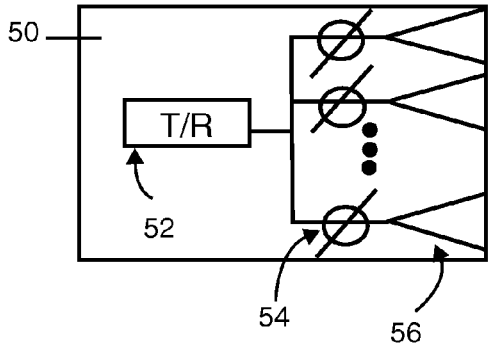
FIG. 5 is a schematic illustration according to the present invention of the communication module that includes a HEMT T/R element.

With reference to FIG. 5, a communication module 50 of the present invention has a transmit/receive module 52 that connects to a row 54 of phase elements. Each phase element in the row 54 of phase elements is connected to a corresponding radiating element in a row 56 of radiating elements.

Figure 6:
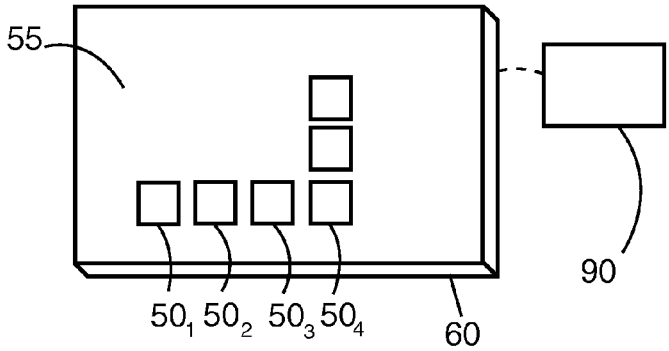
FIG. 6 is a schematic, perspective illustration of the hybrid-phased array of the present invention where a plurality of communication modules are positioned above a single substrate.

In FIG. 6, a communication array 55 has a plurality of communication modules $\mathbf{50}_1$, $\mathbf{50}_2$, $\mathbf{50}_3$, $\mathbf{50}_4$, etc., that are positioned above substrate 60. The array is electrically connected to signal processing electronics 90.

Figure 7:
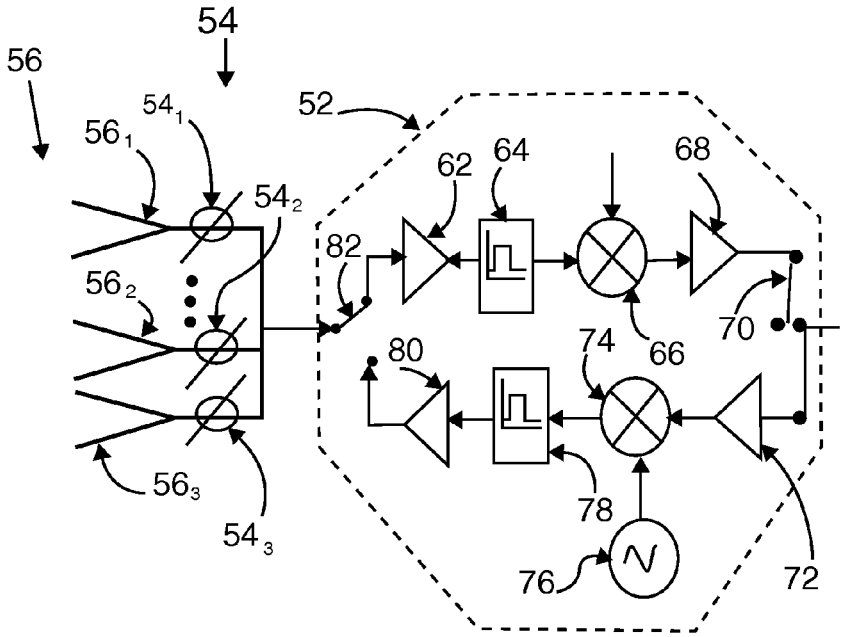
FIG. 7 is a schematic illustration of a T/R element of the present invention that includes a MEMS switch which connects to phased array which connects to an array of radiating elements.

In FIG. 7, the components of the transmit/receive module 52 include a T/R switch 82. The T/R switch 82 alternatively connects the row 54 of phase elements to low noise amplifier 62 during receive mode or to power amplifier 80 during transmit mode. Low-noise amplifier 62 connects to band-pass filter 64 that connects to a mixer 66. Mixer 66 mixes the received signal with a current received from an oscillator with the mixed signal proceeding to amplifier 68. Amplifier 68 connects to a switch 70 which opens and closes depending upon the mode of operation. Amplifier 72 connects to a multiplier or mixer 74 that connects to oscillator 76. A mixed signal proceeds from mixer 74 to band-pass filter 78 to the power amplifier 80.

When T/R switch 82 connects to power amplifier 80, a signal is transmitted to the radiating elements $\mathbf{56}_1$, $\mathbf{56}_2$, $\mathbf{56}_3$. Phase element $\mathbf{54}_3$ is directly connected to radiating element $\mathbf{56}_3$. Phase element $\mathbf{54}_2$ is directly connected to radiating element $\mathbf{56}_2$ and phase element $\mathbf{54}_1$ is directly connected to radiating element $\mathbf{56}_1$. Thus switch 82 connects to the respective phase elements of row 54 which connect to corresponding radiating elements in radiating row 56. Those of ordinary skill in the art realize that different arrangements and/or different components could be utilized to achieve a functional T/R element or module. However, any arrangement of internal T/R components, the use of a PHEMT design will enhance power capabilities. Also, however, the internal components of T/R module are arranged, it is necessary that a switch such as switch 82 be provided to allow for switching during the transmit and receive modes that provides low signal loss.

Each transmit/receive module 52 of the present invention is a psuedomorphic HEMT (PHEMT) so as to be capable of operation at voltages exceeding 10 volts. This power capability allows each transmit receive module to drive multiple radiating elements.

The T/R switch 82 that connects the phase elements $\mathbf{54}_1$, $\mathbf{54}_2$, $\mathbf{54}_3$, to the PHEMT-T/R element 52 of each communication module 50 is a high isolation switch.

The phase shift elements 54 are created using Radio Frequency Microeletromechanical System(RF MEMS) switches that provide low signal loss. This enables multiple phase elements to be driven by a single PHEMT-T/R element 52.

The piezoelectrically actuated structures of RF MEMS switches provide large actuation forces compared to electrostatic switches. Further, RF MEMS switches reduce stiction and thereby increase the reliability of the entire communication module 50.

The HEMT-T-R element 52 and the RF MEMS switch-based phasing elements of the present invention allow the phasing network 54 to be positioned between the radiating elements and the low noise amplifier 62 because RF MEMS provide for the manufacture of low-loss phasing networks.

The efficient and low cost properties of the present invention lend its application to a host of systems and functions ranging from expendable missiles to cell phone technology.

Accordingly, various modifications are possible without deviating from the spirit of the present invention. Accordingly the scope of the invention is limited only by the claim language which follows hereafter.

What is claimed is:

1. A communication module comprising:

a PHEMT-T/R module;

a plurality of phase elements;

a MEMS switch connecting said PHEMT-T/R module to said plurality of phase elements;

a plurality of radiating elements; and wherein each phase element of said plurality of phase elements is directly connected to a corresponding radiating element of said plurality of radiating elements, said plurality of phase elements being positioned between said plurality of radiating elements and a low noise amplifier.

2. A communication module according to claim 1, wherein:

said MEMS switch that connects said PHEMT-T/R module to said plurality of radiating elements is a T/R switch that is located between said plurality of phase elements and said low noise amplifier.

3. A communication device according to claim 2, wherein:

each phase element of said plurality of phase elements comprises an RF MEMS switch.

4. A communication device according to claim 3, wherein:

said MEMS switch alternately and directly connects said plurality of phase elements to said low noise amplifier and a power amplifier.

5. A communication device according to claim 4, wherein:

said MEMS switch, said low noise amplifier and said power amplifier are included within said PHEMT-T/R module, said plurality of phase elements being located outside of said PHEMT-T/R module, said PHEMT-TR module driving said plurality of phase elements.

6. A communication array, comprising:

a substrate;

a plurality of communication modules arranged on said substrate with each of said communication modules having a PHEMT-T/R module having a MEMS switch, a plurality of phase elements connecting to said PHEMT-T/R module and a plurality of radiating elements connecting to said plurality of phase elements, and wherein said plurality of phase elements are positioned between said plurality of radiating elements and a low noise amplifier and said MEMS switch is positioned between said plurality of phase elements and said low noise amplifier.

7. A communication array according to claim 6, wherein:

each phase element of said plurality of phase elements has a MEMS switching means.

8. A communication array according to claim 7, wherein:

said MEMS switch is a T/R switch that alternately connects said low noise amplifier and a power amplifier to said plurality of phase elements.

9. A communication array according to claim 8, wherein:

said plurality of phase elements are located outside of said PHEMT-T/R module, said PHEMT-T/R module driving said plurality of phase elements.

10. A communication module, comprising:

a row of phase elements;

a PHEMT-T/R module for driving said row of phase elements, said PHEMPT-T/R module including a low noise amplifier and a power amplifier;

a row of radiating elements, each phase element of said row of phase elements being directly connected to a corresponding radiating element of said row of radiating elements, said each phase element of said row of phase elements being provided with RF MEMS switching;

a MEMS T/R switch connecting said PHEMT-TR module with said row of phase elements, said MEMS T/R switch alternately connecting said low noise amplifier and said power amplifier to said row of phase elements; and wherein said row of phase elements is located outside of said PHEMT-T/R module, said row of phase elements being connectively located between said row of radiating elements and said T/R switch.

11. A communication module according to claim 10, wherein:

said MEMS T/R switch is located between said row of phase elements and said low noise amplifier.

12. A communication module according to claim 11, wherein said MEMS T/R switch is a high isolation switch.

13. A communication module according to claim 11, wherein:

said row of phase elements has more than two phase elements, said more than two phase elements each comprising an RF MEMS switch.

14. A communication module according to claim 13, wherein:

said row of radiating elements has more than two radiating elements.

15. A communication module according to claim 14, wherein:

said PHEMT-T/R module has means for powering each radiating element of said row of radiating elements.

16. A communication module according to claim 15, wherein:

said PHEMT-T/R module can operate at voltages exceeding 10 volts.

17. A communication module according to claim 11, wherein:

said communication module is one communication module of a plurality of communication modules that form a communication array on a substrate.

18. A communication module according to claim 11, wherein:

said MEMS T/R switch is directly connected to said row of phase elements.

19. A communication module according to claim 10, wherein:

said PHEMT-T/R module has means for powering each radiating element of said row of radiating elements.

* * * * *